United States Patent [19]

Galer

[11] 3,998,355

[45] Dec. 21, 1976

[54] PLASTIC LIDS AND PAILS

[75] Inventor: Herbert W. Galer, Pine Township, Allegheny County, Pa.

[73] Assignee: United States Steel Corporation, Pittsburgh, Pa.

[22] Filed: Mar. 28, 1975

[21] Appl. No.: 563,272

[52] U.S. Cl. ..... 220/304; 220/288; 220/72; 220/74

[51] Int. Cl.[2] ..... B65D 41/04

[58] Field of Search ..... 220/288, 304, 72, 74, 220/83, 306, 265, 266; 206/508; 215/217, 218, 222, 295, 296, 289

[56] References Cited

UNITED STATES PATENTS

| | | | |
|---|---|---|---|
| 876,630 | 1/1908 | Gaynor | 220/296 |
| 2,205,685 | 6/1940 | Conner | 206/508 |
| 2,989,203 | 6/1961 | Bramming | 220/296 |
| 3,108,710 | 10/1963 | Lange et al. | 220/72 |
| 3,425,589 | 2/1969 | Lipske et al. | 220/304 |
| 3,438,535 | 4/1969 | Tisserand et al. | 220/266 |
| 3,815,777 | 6/1974 | Churan | 220/319 |
| 3,844,443 | 10/1974 | Cudzik | 220/304 |

FOREIGN PATENTS OR APPLICATIONS

| | | | |
|---|---|---|---|
| 1,482,560 | 2/1969 | Germany | 220/288 |

*Primary Examiner*—William Price
*Assistant Examiner*—Joseph M. Moy
*Attorney, Agent, or Firm*—John E. Callaghan

[57] ABSTRACT

This invention concerns plastic lids and pails having improved resistance to leakage upon impact. The lids and pails are fastened together by mating threads molded into each.

7 Claims, 5 Drawing Figures

PLASTIC LIDS AND PAILS

BACKGROUND OF THE INVENTION

Large thick-walled plastic containers are used for packaging and transporting materials in the form of liquids and solids. These materials may be solids, liquids or pastes, aqueous or organic, acidic or alkaline, e.g., detergent solutions, latices, foods or condiments, fine chemicals, etc. Three and a half, five-and six-gallon sizes are most common. Because of inertness and toughness, plastics such as high density polyethylene or other inert moldable thermoplastic resins are preferred materials. The containers are filled with the contents, capped, perhaps stored, and shipped. After they are transported to the user, he may also store them. In storage, these containers are stacked one upon the other. After being opened, they may be reopened and closed as the contents are used. There are two common types of container constructions: the wide mouth or open-head pail and the closed mouth or tight-head pail. This invention relates to constructions for open-head pails so that they may have the structural characteristics associated with tight-head pails yet retain the wide mouth access of the open-head pails.

RELATED APPLICATIONS

This application is related to the inventions set forth in applications Ser. No. 563,262, filed Mar. 28, 1975, and Ser. No. 564,944, filed Apr. 3, 1975.

SUMMARY OF THE INVENTION

In this invention, there is an improved lid construction for resisting impact deflection of the sealed joint when closed pails are subjected to forces at their corners. The lids with inverted U-shaped rims have integrally molded threads so that when the pail is closed, there is mating engagement outwardly of the inner leg of the inverted U-shaped rim. In addition, stackability is enhanced by combining these sections with a groove and handle to provide a secure platform for receiving a container bottom. The lids may also have thin upstanding elements for deflection of impact forces. These constructions give relatively easy opening and closing of the lid on the pail yet equal or excel the performance of conventional closed pails utilizing interference fits from snap over tops on the pails.

BRIEF DESCRIPTION OF THE DRAWINGS

The features of the invention are illustrated in FIGS. 1–3.

DETAILED DESCRIPTION OF THE INVENTION

Plastic containers constructed in accordance with this invention comprise a pail or receptacle body, a gasket and a lid. The lid is securely fastened to the pail, while the gasket forms the seal between the lid and the pail. The pail will have an opening at its top substantially the width of the pail, the engagement threads will be located at or near the top of the pail. The lid will cover the open top of the pail and will have its threads about its periphery to cooperate with the threads on the pail for securing the lid to the pail.

Figure 1A:
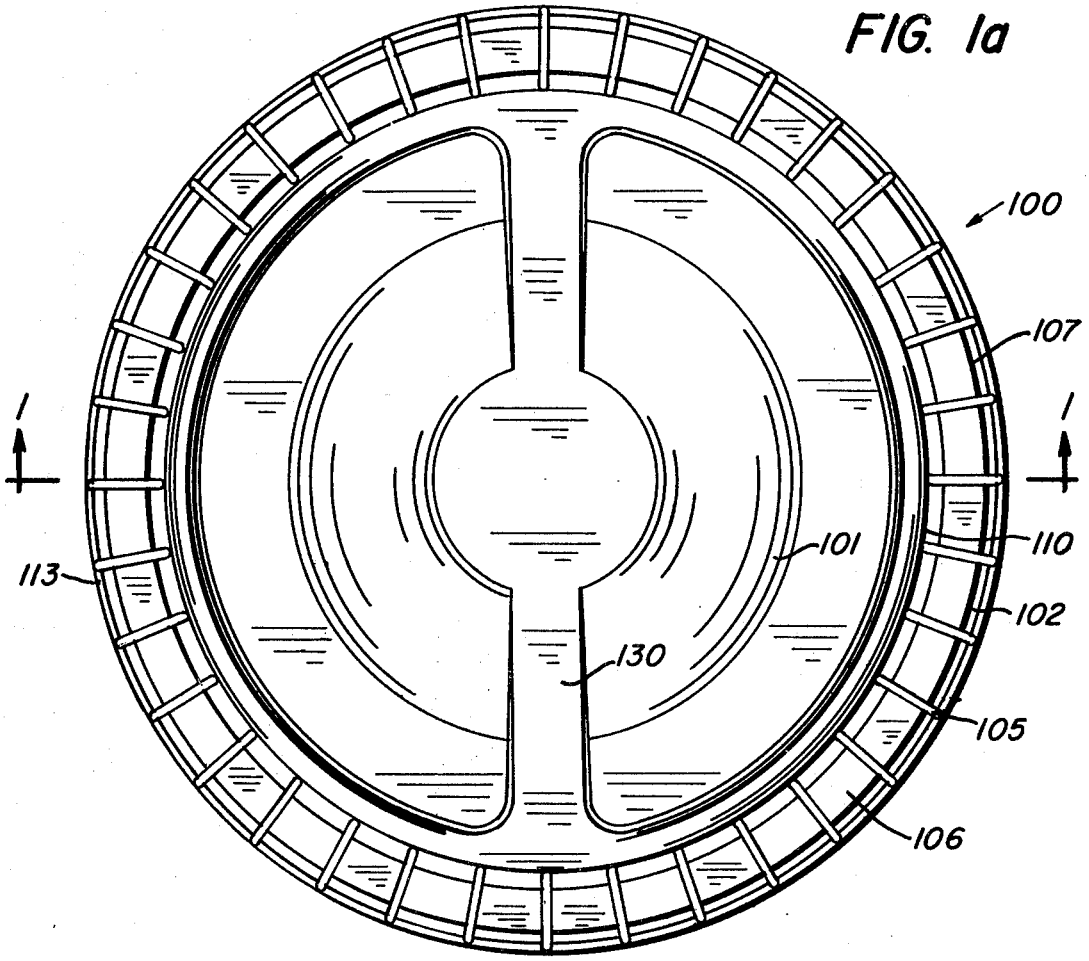
FIG. 1*a* is a plan view of the lid shown in FIG. 1.
Figure 1:
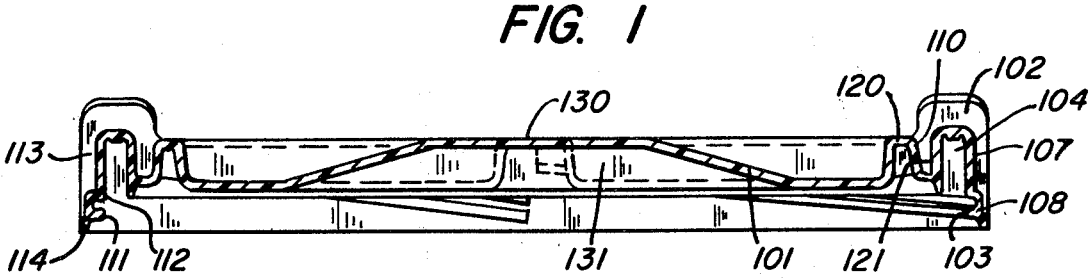
FIG. 1 is a cross section in elevation of a lid according to this invention.
Figure 1B:
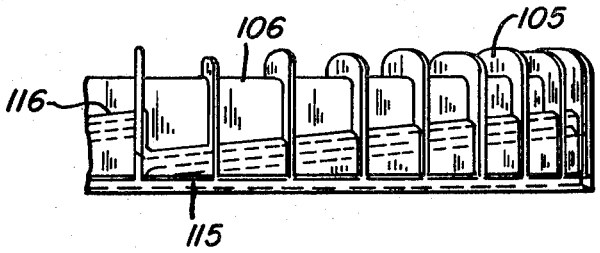
FIG. 1*b* is an elevation in full of a quarter section of the lid shown in FIG. 1.

The lid structures are illustrated in FIGS. 1, 1*a* and 1*b*. The plastic lid 100 has a central closing portion 101. An inverted U-shaped rim 102 surrounds the central closing portion 101. The rim 102 contains the engagement threads for fastening the lid to an open-head pail. The interior of the rim is shaped to include spacing for a gasket 300 to be fitted between the lid and the pail. Projecting from the rim are a plurality of thin plastic members 105. These members are located on the periphery of the rim and extend both from the outer wall 107 of the outer leg of the arch in the region of the arch and upwardly above wall 106 forming the top of the arch of the inverted U. The form, member and spacing of the threads depend upon the ease of opening sought for the closed pail, the material being molded and the manner in which compression is to be placed upon the intermediary gasket. In general, threads having parallel planar faces are preferred so that an additional sealing effect can be achieved as is explained later. These faces may lie in planes that are normal to the central axis of the lid or these planes may be inclined at an angle to the central axis so that the threads extend downwardly from the sidewall of the inverted U-shaped portion. With threads that are arcuate segments, the lids can be fastened or removed readily from the pails. Where each segment has an included arc of less than 120°, preferably 90°, there is balanced force on the rim of the pail as the lids are fastened. There may be several threads arranged one above the other. These are spaced so that upon initial closing of the lid, the intermediary gasket is engaged by both the pail and the lid. In a preferred construction of lid with a gasket compression member 104, the spacing is such that upon initial closing, the gasket is deformed into a figure 8, further fastening of the lid to the pail causes additional compression on the gasket.

A standard test for tight-head pails, the D.O.T. four foot drop test, can be used to good advantage for observing the benefits of this invention. In both versions of the test, the assembly of pail and lid is dropped from a height of four feet onto a floor. In one version, the direction is such that the corner of the lid strikes the floor at an angle of 45°. In the other version, the direction is such that the axis through the center of the pail is parallel to the floor. Usually, the container is filled with water. At the time of impact, noticeable deflection occurs in the conventional lids with open-head pails that causes the circular shape to become wrinkled. In the pail, there is also a noticeable deflection or kink at the top section. Furthermore, leakage from the assembly is shown by spillage of liquid. By using this invention, the deflection of both the lid and the pail can be controlled as well as avoidance of leakage.

A particularly advantageous construction results when the engagement threads of the lid are combined with a second inverted U-shaped portion 120 adjacent to the rim of the lid. This second portion 120 extends above the central closing portion and ends below the outer wall 106 forming the top of the inverted U section of the rim. The upstanding members together with the second U-shaped portion form a receptacle for receiving the bottom section 230 of a pail 200, the bottom being shown in phantom outline in the partial cross section of the lid in FIG. 3. With this construction, several closed pails can be assembled on top of each other. The lower pail will securely hold the next adjacent upper pail and the inverted U-shaped portion of the lid can withstand heavy loads without deflection of the lid. By having the upstanding members 105 formed integral with the outer wall 110 of the inner leg of the rim and the outer leg of the second inverted U-shaped portion, the resulting lid structure tends to act as a unit in dissipation of impact forces on the rim and the resistance to vertical loads.

The lids are fastened to the pails with engagement threads 111, 112 in the outer leg 113 of the inverted U-shape of the rim. These are adapted to mate with corresponding threads on the pail. Those shown in FIG. 1 have a generally buttress form and a long pitch and each thread extends about one-quarter of the circumference of the lid. This gives a large mechanical advantage (9/1 or greater); the lid can easily be engaged or disengaged with high compression on the gasket. With the upstanding members of the lid, the seal between lid, gasket and pail is protected. The threads may be disposed with one of a full section 111 and one with a half section 112 as the next adjacent thread face. Inasmuch as the lids are made by injection molding, a preferred form of lid having screw threads for engagement also has the outer wall 113 of the inverted U in the rim 115, 116 contoured to follow in parallel the upwardly rising threads 113 as shown in FIG. 1*b*. This simplifies the manufacturing techniques and allows a uniform wall thickness over the whole cross section of the lid. Furthermore, when polyethylene or a similar resin with high slippage is the material of construction, the lids having screw threads should also have a secondary locking device so that vibration during transportation does not cause the lid and pail to loosen by slippage. One such device is notches 114 formed in the lower edge of the outer wall of the lid for locking onto short posts or bars 214 on the pail. When the lid is in its tightly closed position on the pail, the bar or posts will be just tall enough to penetrate and engage the notches for a completely secure container. Rather than mechanical structures such as notches, light coating of adhesives will secure the lid against vibration during shipment. The lid may also be disengaged by hammer blows.

An integrally formed handle in the central closing portion of the lid may be in the form of a hollow bar 130 rising above and across the central closing portion. The sidewalls 131 of the bar present large flat vertical areas for closing or opening the container. In closing, automatic cappers having rotating grippers or bars can bear on the flat surfaces of the handle and quickly close the lid. In opening, automatic machinery or simple tools such as hammers can be used to overcome the locked notch and post and then unspin the lid. By having lids with the screw threads, the containers may be opened without the use of pry bars, knives, etc., to cut away portions of the lid and may readily be reclosed and reopened.

Figure 2:
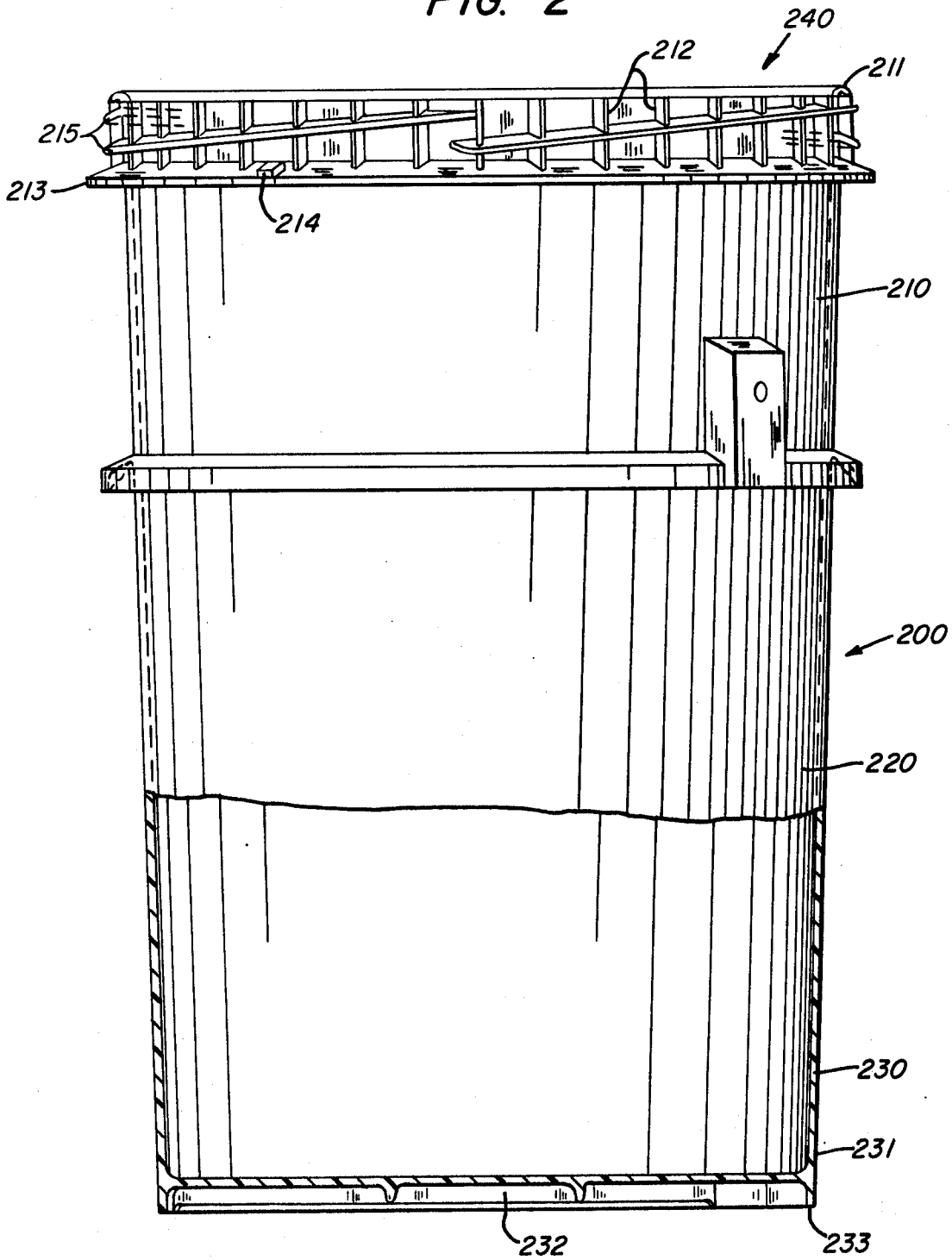
FIG. 2 is an elevation, partly in cross section, of a plastic pail according to this invention.

The plastic pail structures of particular interest are those having a wide-mouth opening, open-head pails. As shown in FIG. 2, the pail 200 has a topmost section 210, an intermediate section 220 and a bottom section 230. The topmost section has the matching engagement threads for the lid located at the mouth of the pail.

Figure 3:
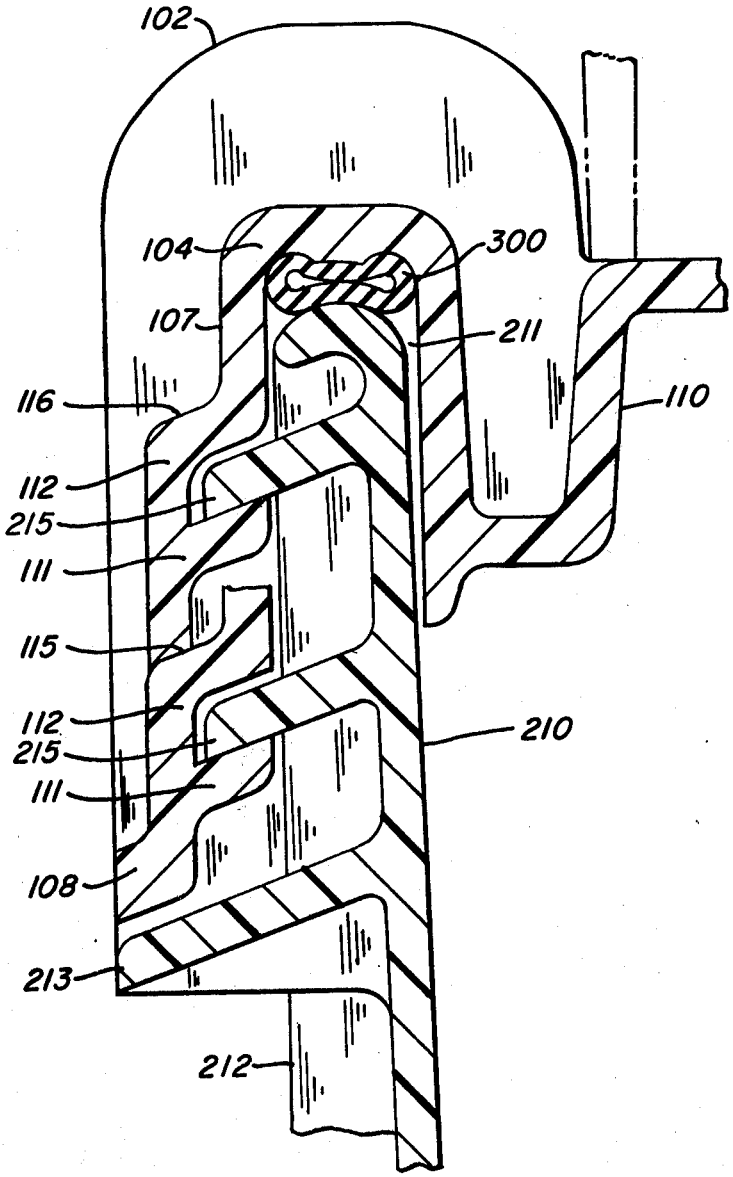
FIG. 3 is an elevation of an enlarged cross section showing the lid of FIG. 1 combined with the pail of FIG. 2.

Reinforcing members 212 in the form of thin integrally molded elements extending outwardly from the outer sidewall of the pail to the mid region of the engagement threads and extending through the vertical segment of the topmost section can be used. These members 212 tend to stiffen the topmost section of the pail against deflection and from impact forces and transfer or distribute such deflection to the intermediate section. It is preferred that the reinforcement members extend into the screw thread a distance sufficient to reduce deflection of the individual thread. As shown in FIG. 3, the reinforcing members form a girder-work projecting radially to about midway of the thread. This increases the stiffness of the free end of the thread. The thread can extend outwardly of the rim 211 of the pail. As a consequence, the interior of the arch in the lid and the arrangement of the top section of the pail can be dimensioned so that the engagement means of the lid and the pail are mated at a position that is exterior of the rim 211 of the pail. Thus the lateral dimensions for the engagement means can be independent of the lateral dimension of the interior of the U-shaped arch in the lid and the pail which hold the compression on the gasket. The result is a wider manufacturing tolerance in the dimensions of the molded plastic parts while the mating engagement parts can be securely fastened.

The reinforcing members on the pail may be oriented in the direction of draw of the mold which forms the pail. Then, these members will form an acute angle with a radius through the axis of the pail which passes through the intersection of the pail and the members. The members are arranged to form a stiff reinforcing action in the topmost section of the pail without a substantial mass of resin being present. A preferred assembly is for vertical members to extend down from the top of the pail to a peripheral shoulder 213 extending outwardly from the pail. The engagement threads will be disposed as a helix upwardly along the pail axis and will extend from the top of the pail to the peripheral shoulder. The reinforcing elements may have a uniform thickness or may be thicker in the portion above the thread and thinner below the thread.

The bottom section 230 of the pail has a vertical sidewall section 231 and a horizontal bottom wall section 232 which is disposed above the lower edge 233 of the sidewall section 231. The lower edge 233 of the sidewall section is shaped to repose within the peripheral rim of a lid similar to that described above. The stacking feature of the lid and pail combination is illustrated in FIG. 3 with the adjacent pail bottom shown in phantom outline.

An illustrative example of a specific container having a capacity of 6 gallons and constructed according to this invention with the configuration shown in FIGS. 1–3 would have the following representative dimensions, the Figures themselves being approximately to scale. High density polyethylene would be injection molded to form the lid 100 and the pail 200. The lid has an overall diameter of 12.5 inches, the central closing portion is 9.38 inches in diameter. The inverted U-shaped rim has an interior span of 0.624 inches. The thread depth is 0.175 inches. The span between the outer wall of the inner leg of the U-shaped rim and the wall of the adjacent wall of the inverted U-shaped portion is 0.275 inches. The entire span of the U-shaped portion is 0.70 inches. The typical wall thickness for the lid is 0.10 inches.

The upstanding members 105 may be spaced at 10° intervals, they are 0.07 inches thick. The overall height of the member is 1.175 inches.

The inverted U-shaped rim is about 1.575 inches high, while the adjacent inverted U-shaped portion is 0.70 inches. As shown, the adjacent U-shaped portion is elevated from the mid-point of the rim. The thread shown is 0.100 inches thick and rises 0.50 inches in each arcuate segment. The handle portion is about 0.60 inches high.

The pail is 17.5 inches high overall with an average wall thickness of 0.10 inches. The topmost section would be 6.225 inches from the rim to the circumferential shoulder section bearing the handle. The intermediate section is about 11.5 inches and the bottommost section is about 0.75 inches. In the bottommost section, the outer walls extend about 0.4 inches below the floor of the pail.

The top of the pail is 11.8 inches in diameter. The rim diameter of the top is 11.25 inches. The rim has a radius of 0.156 inches. The screw threads are 0.10 inches thick and extend 0.79 inches from the sidewall. These threads are disposed to match those on the lid. There is a taper in the width of the pail so that it is 10.5 inches in diameter at its bottom.

The reinforcing members 212 project about 0.55 inches from the side wall and extend down from the rim for about 1.125 inches. These are oriented at a slight angle to the surface of the side wall so that when the pail is molded, segmented mold parts can move radially away from the pail. These members are 0.05 inches thick and there are 36 in number, spaced about the circumference of the pail. On the shoulder 213, small posts extend upwardly about 0.1 inch. These are to engage the notches which are found in the bottom of the rim on the lid. In the arch of the lid, space is provided between the compression member 104 and the rim of the pail to allow about 0.06 inches for the compressed gasket. The compression member causes the gasket to initially squeeze when the lid is first fitted to the pail. The further engaging of the lid and the pail results in a fully compressed gasket which forms an especially effective seal.

It has been found that when the assembled lid and container are subjected to impact force, e.g., by being dropped to land on its corner, there is a further tightening of lid and pail. In the event it is desired to quickly loosen the threaded engagement, slots can be provided in the lid so that implements such as screwdrivers can be used to make an initial separation between the lid and the pail. As an alternative, by deliberately applying a separate impact force to the assembled lid and pail, the seal between them can be further improved.

It is contemplated that the lid may contain smaller pour openings as part of its structure. In this manner, the open head pail structure can be used with the small pour opening fittings common for tight head pails.

The common capacity for the pails of this invention are 3.5, 5 and 6 gallons. Other sizes can be made utilizing the advantages of this invention. As well, variations in the size and shape of the parts of the lid and the pail can be made. These and other changes such as materials of construction as would be apparent to those versed in this field are within the invention set forth in the following claims.

I claim:

1. A stiff molded plastic lid having a central closing portion and an inverted U-shaped rim, said rim being adapted for engagement with an open head pail, said pail having a top portion including a rim and engagement means, said inverted U-shaped rim being in the form of an inner leg having an inner and outer wall, an outer leg having an inner and outer wall and an arch connecting said inner and outer legs, said arch and the inner walls of said legs being spaced to receive a compression gasket and said top portion of said pail whereby the compression gasket fits between the interior of said inverted U and the rim of said pail and wherein engagement means on the inner wall of the outer leg of said inverted U receive the engagement means on said pail for engagement at a position exterior of the rim of said pail, the engagement means on said pail being in the form of mating threads extending outwardly from the sidewall of said pail and to a position outwardly of the rim of said pail, the engagement means on the outer leg of said inverted U-shaped rim being in the form of screw threads that are arcuate segments extending upwardly along the axis through the center of said lid and have generally planar faces and being parallel to each other, said threads extend outwardly from the inner wall of the outer leg of said inverted U for mating with the threads on said pail, the thickness between the outer wall and the inner wall of said outer leg being substantially uniform so that the outer leg of said inverted U is contoured to follow in parallel the upwardly extending profile of said threads, said lid also containing additional locking means for resisting vibration and said lid being capable of providing an assembly with said gasket and said pail which can withstand the impact arising from a vertical drop of four feet.

2. The lid of claim 1 having an inverted U-shaped portion adjacent to said rim, said portion extending above the central closing portion and ending below the arch of said rim, and an integrally molded handle portion extending across said lid, said inverted U-shaped portion and said handle portion cooperating to form a support for a pail when said pail is positioned on said lid.

3. The lid of claim 1 wherein said threads of said lid have a relatively long pitch.

4. The lid of claim 1 wherein the thickness between the outer wall and the inner wall of said inner leg, the thickness of the threads of said lid and the thickness of said outer leg are substantially uniform.

5. The lid of claim 1 wherein said threads are segments having an included angle with respect to the central axis of said lid of 90°.

6. The lid of claim 1 wherein said threads are disposed in pairs with one thread above another.

7. The combination of a lid, a gasket and a pail, said lid being a stiff molded plastic lid having a central closing portion and an inverted U-shaped rim, said pail having a top portion including a rim and engagement means, said inverted U-shaped rim being in the form of an inner leg having an inner and outer wall, an outer leg having an inner and outer wall and an arch connecting said inner and outer legs, said arch and the inner walls of said legs being spaced to receive said compression gasket and said top portion of said pail and having the compression gasket between the interior of said inverted U and the rim of said pail and having engagement means on the inner wall of the outer leg of said inverted U engaged with the engagement means on said pail at a position exterior of the rim of said pail, the engagement means on said pail being in the form of mating threads extending outwardly from the sidewall of said pail and to a position outwardly of the rim of said pail, the engagement means on the outer leg of said inverted U-shaped rim being in the form of screw threads that are arcuate segments extending upwardly along the axis through the center of said lid and have generally planar faces and being parallel to each other, said theads extend outwardly from the inner wall of the outer leg of said inverted U for mating with the threads on said pail, the thickness between the outer wall and the inner wall of said outer leg being substantially uniform so that the outer leg of said inverted U is contoured to follow in parallel the upwardly extending profile of said threads, said lid also containing additional locking means for resisting vibration and said combination being capable of providing an assembly with said gasket and said pail which can withstand the impact arising from a vertical drop of four feet.

* * * * *